United States Patent [19]

Kohyama

[11] Patent Number: 4,686,934

[45] Date of Patent: Aug. 18, 1987

[54] DEVELOPING DEVICE

[75] Inventor: Mitsuaki Kohyama, Higashikurume, Japan

[73] Assignee: Kabushiki Kaisha Toshiba, Kawasaki, Japan

[21] Appl. No.: 896,565

[22] Filed: Aug. 14, 1986

Related U.S. Application Data

[63] Continuation of Ser. No. 775,396, Sep. 12, 1985, abandoned.

[30] Foreign Application Priority Data

Oct. 29, 1984 [JP] Japan ..... 59-227411

[51] Int. Cl.[4] ..... G03G 15/06

[52] U.S. Cl. ..... 118/651; 118/656; 118/658

[58] Field of Search ..... 118/651, 656, 658

[56] References Cited

U.S. PATENT DOCUMENTS 3,638,614 2/1972 Young .

4,155,329 5/1979 Tsukamoto .

4,237,819 12/1980 Ikegami .

4,383,497 5/1983 Tajima ..... 118/651

4,385,829 5/1983 Nakahata .

*Primary Examiner*—Bernard D. Pianalto

*Attorney, Agent, or Firm*—Oblon, Fisher, Spivak, McClelland & Maier

[57] ABSTRACT

A developing device comprises a developer bearing member to form thereon a developer layer with carrier particles which attracts toner particles; a toner holding member which passes by the developer bearing member and faces the developer layer such that toner particles are received to form the toner layer on the toner holding member, and which passes a developing station; a DC voltage source for applying DC voltage between the developer bearing member and the toner holding member for separating toner particles only from the developer held on the developer bearing member and adsorbing it to the toner holding member; and an elastic blade to making contact and slide the toner particles held on the toner holding member.

10 Claims, 6 Drawing Figures

DEVELOPING DEVICE

This application is a continuation of application Ser. No. 775,396, filed Sept. 12, 1985 now abandoned.

FIELD OF THE INVENTION

The present invention relates to a developing device for developing an electrostatic latent image.

BACKGROUND OF THE INVENTION

Developing in the dry-type electrophotographic method is the most important element which has influence directly on the image quality, and various methods such as the cascade method and the magnet brush method have conventionally been used. The reason is that, in these developing methods, toner is easly charged and a stable image can be obtained.

However, in the cascade method, it is impossible to copy the solid part of an image satisfactorily due to fringe effects at developing. In the magnet brush method, such defects are few. The magnet brush method as commonly used, however, has the defect that the life of the carrier particles used with the toner particles is comparatively short. Therefore, it is necessary to replace the carrier particles every time after copying ten thousands of pictures.

For removing such defects in these methods, a system where the shape and the material of the carrier particles were improved has appeared recently, but it is not sufficient. Under the circumstances, a copying machine using the so-called magnetic one component developing system has been introduced. This system is classified into two systems, one using a conductive toner and the other using an insulating toner. For the requirement of improving moisture proofness, it is the technical target to select the latter. The expression of the target means that some problems still remain in this technology. The source of the problems is generated because toner can not be charged stably. For this reason, defects of an image such as uniformity, background, and density are produced causing an obstacle to a copying machine high in completeness.

Also, as another advantage of the one component system, it is possible to develop in noncontacting state with the electrostatic latent image surface. This advantage is an important element in color copy technology where overlap developing is required. However, so far as magnetic toner is used, it is difficult to make toner colored. The reason is that most magnetic powders that might be used for toner are black or brown, and the color of the toner becomes remarkably muddy when mixed.

For satisfying the above requirement, the necessity of a developing system where an image is produced on the electrostatic latent image surface by using non-magnetic toner in noncontacting state has been increased. However, this involved many unsatisfactory elements in this non-magnetic one component developing system when non-magnetic toner is practically used for copying machines. One of the well-known techniques is a method where an image is developed by forming a thin layer of toner on the surface of a conductive roller and making it face a developing surface having an electrostatic latent image at a space of 600 um or less, preferably 250 um or so. This method, however, has the following two disadvantages. First, there is no reliable means for forming a thin layer (50 μm or less) of toner. At present, a method of applying toner by pressing a rubber blade against a roller is generally known, but there remains such problems as density of the toner layer to be formed and wear of the blade. Second, the formed thin layer of toner must be charged uniformly. In this means, the charging rate of toner is low, a satisfactory charging and stability can not be obtained, and the image quality also is unstable. A trial was made for improving the charging quality and the film forming quality of the toner, but improvement of the toner is put under a large burden. This means, therefore, is at the experimental stage in laboratories. The same problem also for developing toner materials to improve the charging nature on the roller surface still remains.

The conventional developing device (see, e.g., U.S. Pat. No. 4,383,497) comprises a magnetic roller to form a magnetic brush with a two component developer consisting of magnetic carrier particles which electrostatically attract toner particles and a developing roller which passes by the magnetic roller and contacts the magnetic brush such that the toner particles are separated from the magnetic carrier particles and then the toner particles are received on the developing roller, and which passes a developing station where the development is affected. However, in this conventional device, a satisfactory and stable image quality was obtained, but an unfavorable defect was generated that toner is scattered in the copying machine when toner is separated from the two component developer.

OBJECTS OF THE INVENTION

The present invention has been made in view of the above-mentioned points of problems, and aims at providing a novel and excellent developing device.

Another object of the present invention is to provide a developing device in which a thin layer of non-magnetic toner can be easily formed and a satisfactory changing toner layer can be formed on a developing roller.

Still another object of the present invention is to provide a developing device in which toner only is separated from two component developer on a developing roller to perform non-contacting developing and in which an image can be developed satisfactorily without scattering of toner.

SUMMARY OF THE INVENTION

For achieving the above objects, the developing device of the present invention is constructed so that an image can be developed by separating toner only from two component developer to form a toner layer on the developing roller, by then contacting an elastic member elastically on the toner layer, to make it slide on the toner layer and by transferring toner based on the electrostatic field to be formed at a space between the electrostatic latent image holding body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
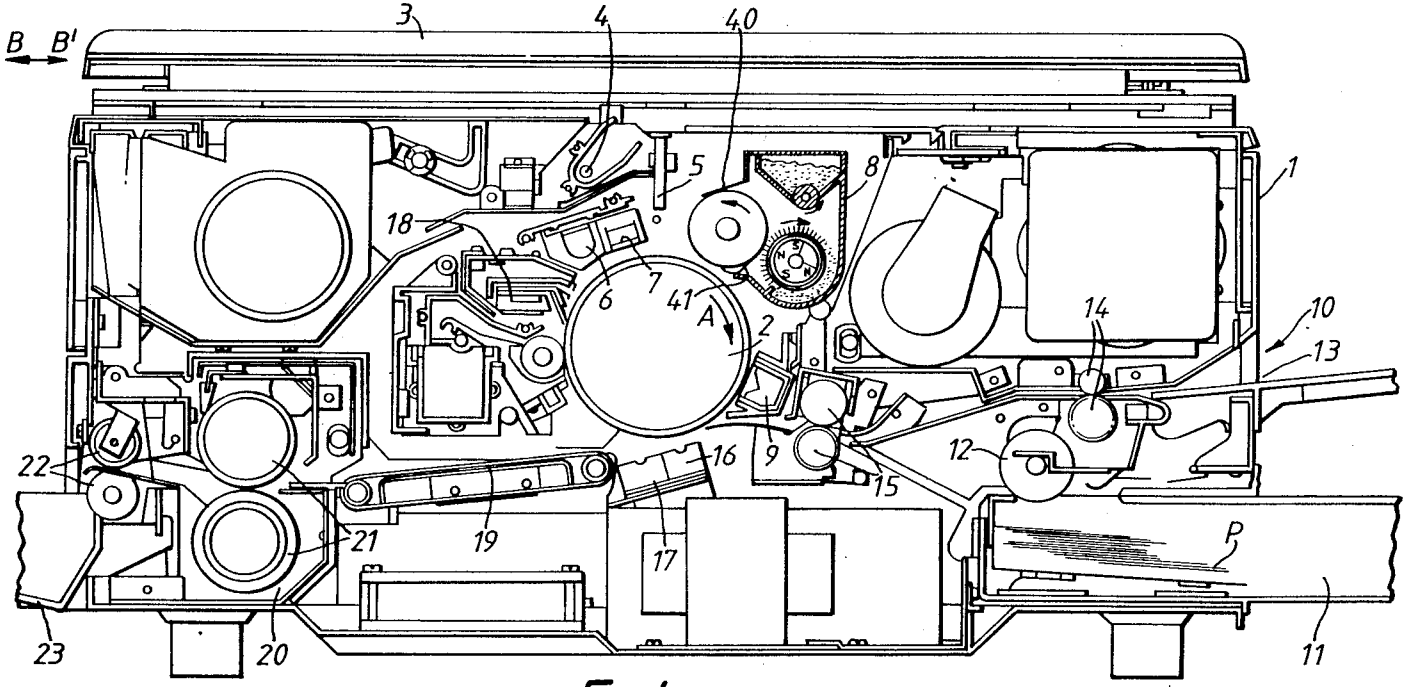
FIG. 1 is a schematic cross-sectional side view of a copying machine in which the developing device of the present invention is employed.

Referring now to the drawings, wherein like reference numerals designate identical or corresponding parts throughout the several views, FIG. 1 is a schematic cross-sectional side view of a copying machine in which the developing device of the present invention is employed. In substantially the center of a casing 1 of the copying machine, a photosensitive drum 2 comprising selenium and tellurium alloy is rotatable in the direction of arrow A. At the upper part of the casing 1, an original table 3 is provided to place thereon an original. The original Table 3 is reciprocative in the direction of arrows B and B'. At the lower part of the original table 3, an exposure is provided to irradiate light to the original placed on the original table 3. Light can be irradiated from one end to the other end of the original with movement of the original table 3. A reflecting light from the original is irradiated on the surface of the photosensitive drum 2 through an optical lens array 5.

Near the photosensitive drum 2, a discharge lamp 6 is provided to erase any image (residual charges) remaining on the rotating photosensitive drum 2. A DC corona charger 7 is provided next to the discharge lamp 6 to charge the surface 2*a* (see FIG. 2) of the photosensitive drum 2 to be positive. An electrostatic latent image is formed on the surface 2*a* of the photosensitive drum 2 charged by the DC corona charger 7 after it has been discharged by the discharge lamp 6, by exposing the surface 2*a* to the reflecting light from the original placed on the original table 3.

In the forward direction of the DC corona charger 7, a developing device 8 is provided for developing the electrostatic latent image by developer or toner. Further, in the forward direction of the developing device 8, an AC corona charge remover 9 is provided to fine negatively charged toner on the photosensitive drum 2, with removes charges on the photosensitive drum 2.

In the forward direction of the AC corona charge 9, a sheet feeder 10 is provided for supplying sheets under the photosensitive drum 2. The sheet feeder 10 is removably provided on the side of the casing 1. It comprises a sheet cassette 11 storing a plurality of sheets P and a feed roller 12 taking out copy sheets P from the sheet cassette 11. Further, above the sheet cassette 11, a bypath-feed device 13 is provided, and feed rollers 14 are provided for feeding forward copy sheets P fed from the bypath-feed device 13. Also, aligning rollers 15 are provided for positioning the leading edge of copy sheets P fed from the sheet cassette 11 or the bypath-feed device 13 and for transporting copy sheets P.

In the forward direction of the sheet feeder 10, an image transfer charger 16 is provided for transferring the image formed on the surface of the photosensitive drum 2 to copy sheets P transported by the aligning rollers 15. A sheet separation charger 17 is provided next to the image transfer charger 16 for separating copy sheets P on which the image has been transferred from the photosensitive drum 2. In the forward direction of the sheet separation charger 17, a cleaner 18 is provided for recovering and accumulating the toner remaining on the photosensitive drum 2 after image transferring.

Copy sheets P separated after image transferring are transported to a fuser 20 by a transportation belt 19. The fuser 20 is a device fixing the developed image transferred on the transported copy sheets P with heat rollers 21. Copy sheets P fixed by the fuser 20 are taken out on an external receiving tray 23 through discharge rollers 22.

Figure 2:
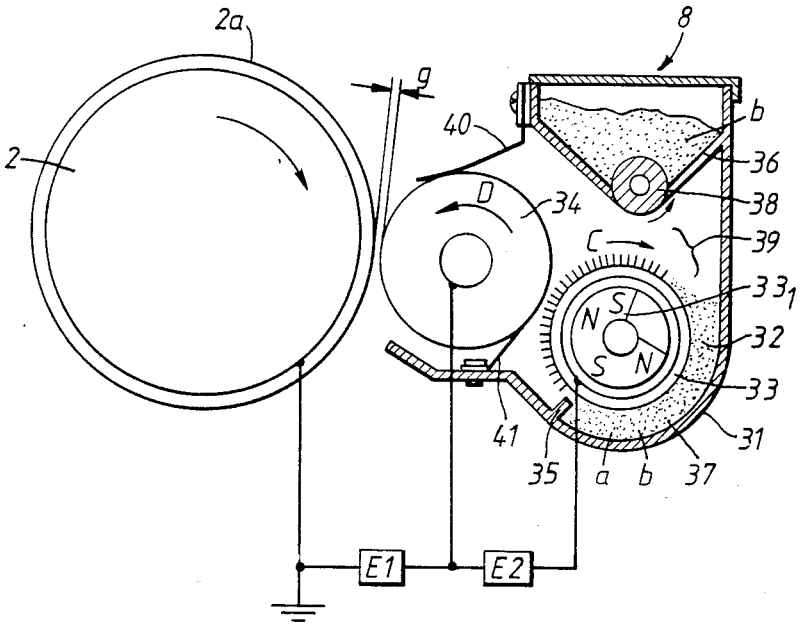
FIG. 2 is a schematic structural diagram of an actual developing device according to the present invention.

FIG. 2 shows a construction of the developing device 8. In a casing 31, a developer 32 is stored. The developer 32 comprises a magnetic carrier such as iron particles and ferite a and 2.0–7.0 weight percent mixed and negatively charged toner b. Also, in the casing 31, a non-magnetic cylindrical sleeve 33 is provided as a developer bearing member, which is rotated in the direction of arrow c shown in the drawing. A magnet $33_1$ in which magnetic poles N and S are alternatively disposed is fixedly provided inside the non-magnetic cylindrical sleeve 33.

Further, in the casing 31, a developing roller 34 is provided as a toner holding member, which is rotated in the direction of arrow D shown in the drawing. The developing roller 34 is disposed close to the non-magnetic cylindrical sleeve 33 and faces the photosensitive drum 2 at a gap g. A thickness regulating plate 35 is provided on the inside wall of the casing 31 for regulating the thickness of the magnetic brush formed on the non-magnetic cylindrical sleeve 33 to 1.0–4.0 mm. A toner hopper 36 and a sponge roller 38 supplying the toner b in the toner hopper 36 to a developer storing portion 37 are provided above non-magnetic cylindrical sleeve 33.

Figure 3:
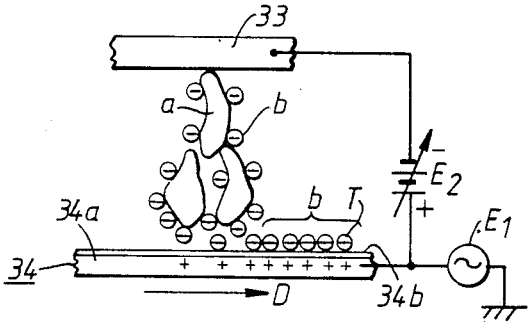
FIG. 3 is a diagram for explaining the state of separation operation of toner of the developing device according to the present invention.

As shown in FIG. 3, the developing roller 34 has a construction in which a layer 34*b* of oxidized aluminum-treated epoxy system or polyamide system resin is formed as an insulative layer or a resistive layer of 5.0–60.0 μm thickness on the surface of a conductive member 34*a* such as aluminum.

By providing the layer 34*b* of an insulative layer or a resistive layer on the surface of the developing roller 34, as shown in FIG. 3, concentration of a partial current is prevented when the toner b is separated by voltage applied between the carrier a, the toner b, and the developing roller 34 and uniformity of the layer thickness of the toner b is obtained. Also, the surface of the developing roller 34 is roughing treated to approximately to 0.5–2.0 μm. This contributes to uniformization of the toner layer. The surface treatment, especially the resistive layer treatment, is not always necessary, and a metal roller without surface layers can sometimes be used.

The developing roller 34 is rotated at substantially equal peripheral speed to the peripheral speed of the photosensitive drum 2, and the non-magnetic cylindrical sleeve 33 is rotated at a peripheral speed of two or three times that speed in the same direction or the reverse direction to the developing roller 34. Also, the developing roller 34 is connected to an AC power source $E_1$ one end of which is earthed. Further, a DC power source $E_2$ is connected as an electrical means between the developing roller 34 and the non-magnetic cylindrical sleeve 33.

Next, separation of the toner a between the developing roller 34 and the non-magnetic cylindrical sleeve 33 is described referring to FIG. 3. For example, when a DC voltage $E_2$ of 200–600 V is applied between the developing roller 34 and the non-magnetic cylindrical sleeve 33 as shown in FIG. 3, toner b negative charged by friction is adsorbed electrostatically to the developing roller 34, and a thin layer T is formed on the resistive layer 34*b* of the developing roller 34. The thickness of the thin layer T is adjusted by the voltage to be applied, but, usually, the thickness is formed by 2 or 3 layers of toner b having particle diameter of 10 μm or so, that is, it is 20–30 μm or so. The toner layer T formed as mentioned above is separated from the two component developer 32, and it is formed by toner particles uniform and charged in a desired quantity. Therefore, when the toner layer T faces the photosensitive drum 2 at the gap g of 0.1–0.7 mm in the developing station, it displays function where substantially the same developing sensitivity as normal electrophotographic developing method can be obtained. In this case, the toner b flies over the gap g, and it is necessary to set the gap g to 0.2–0.3 mm to hold resolution. Further, for giving a change of flying of toner b and for giving electrical shaking effect, apply AC bias voltage of 0.4 kV. As a result, the minuteness in image quality and the sensitivity in a low density area can be improved.

The two component developer 32 in the developer storing part 37 scatters a goodly amount of toner b by rotation of the non-magnetic cylindrical sleeve 33, and a toner cloud is filled in a space 39 in the developing device 8. In a conventional developing device, this toner cloud is spouted from the developing device and soils the inside of the copying machine. However, in this device, for shielding this completely, elastic blades 40 and 41 made of stainless steel or phosphor bronze as an elastic member are made to contact elastically the developing roller 34. In this case, the important matter is to press the developing roller 34 with a uniform force so that the uniformity of the toner layer separated from the two component developer 32 and formed on the developing roller 34 by a magnetic brush is not reduced. For this reason, the elastic blades 40 and 41 are positioned so that they contact the roller surface and so that the linear pressure of elastic blade 40 is 50–200 g/cm and that of the elastic blade 41 is 40–100 g/cm. Thus, the toner b is transported smoothly, and the triboelectric charging effect due to the sliding contact of the separate toner layer T and the elastic blades 40, 41 and removal of brush trace due to the magnetic brush are performed satisfactorily. As a result, a high quality image can be obtained.

The thickness of the elastic blades 40 and 41 used in this case were 0.1–0.25 mm, and the length from the fulcrum of the elastic blades 40, 41 to the contact surface of the developing roller 34 is approximately 30–40 mm. These numerical values were formed to be optimum. However, these values change by material and construction, and they are not always absolute. Also, the elastic blade 41 is not always required when the machine is used for a short period of time because the thickness regulating plate 35 prevent scattering of toner beneath the developing roller 34 so that little toner is spouted.

The reason that "a contacting type shield" in such a manner was not thought of previously is that a proper shielding means by contact could not be found because the toner layer T formed on the developing roller 34 is disturbed by a slight external force. In this invention, however, it has been found that this problem is settled by performing "surface contact" of a plate-shaped elastic member. As a result, prevention of spouting of the toner b has been achieved by this invention.

Figure 4:
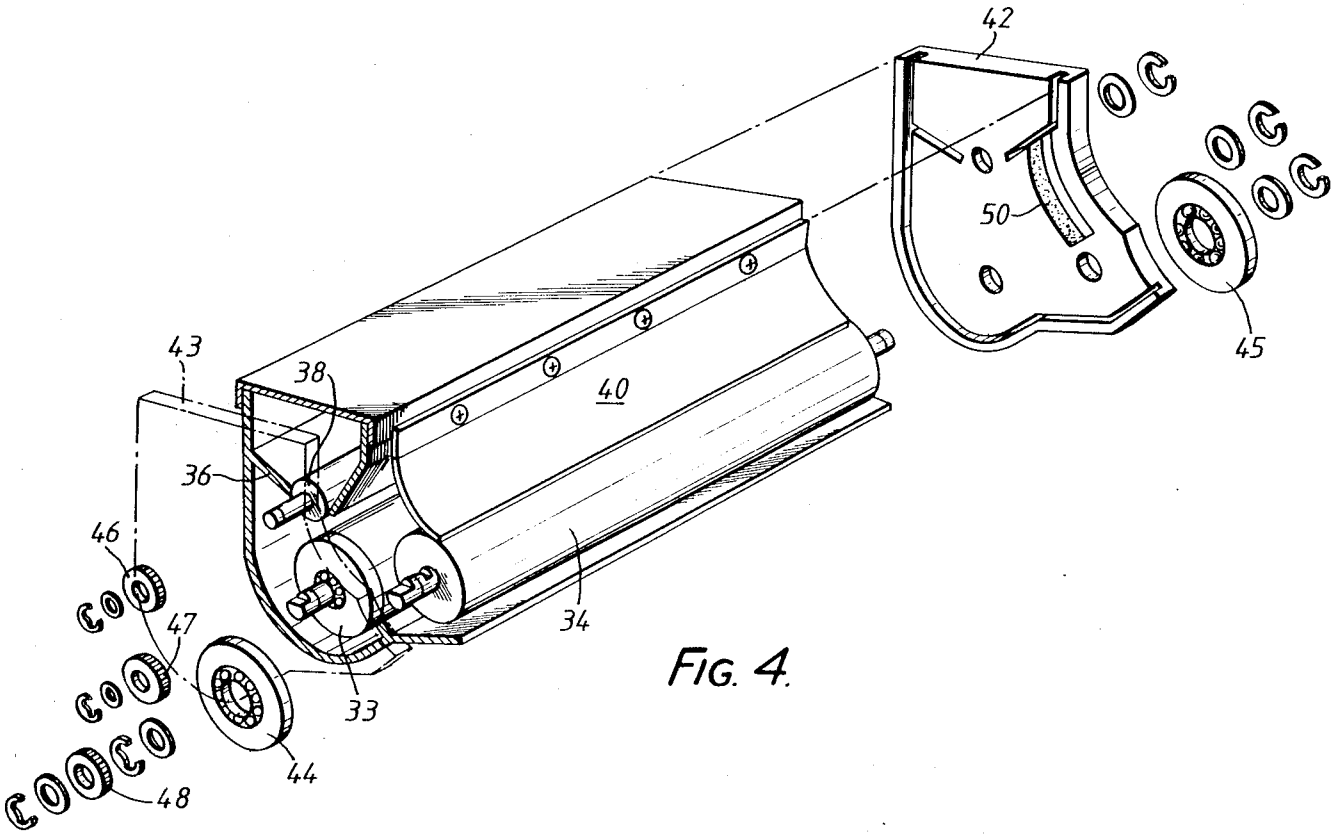
FIG. 4 is a disassembled perspective view of the developing device according to the present invention.

FIG. 4 is a disassembled perspective view of the developing device 8 where the elastic blade 40 is used. As the components other than those already described, there are provided side frames 42 and 43 for fixing the developing roller 34, the non-magnetic cylindrical sleeve 33, and the toner hopper 36. Also, gears 46, 47 and 48 for driving the sponge roller 38, the non-magnetic cylindrical sleeve 33, and the developing roller 34 are mounted.

Further, on both ends of the shaft of the developing roller 34, guide rings 44 and 45 having outside diameters 400–500 μm larger than that of the developing roller 34 are provided. By rotating with this contact the both end surfaces of the photosensitive drum 2, the gap g between the developing roller 34 and the photosensitive drum 2 is held in high precision. Inside the side frames 42 and 43, felts 50 are provided so that they shield the edges of both ends of the elastic blade 40. By these felts, leaking of the toner b is prevented.

Figure 5:
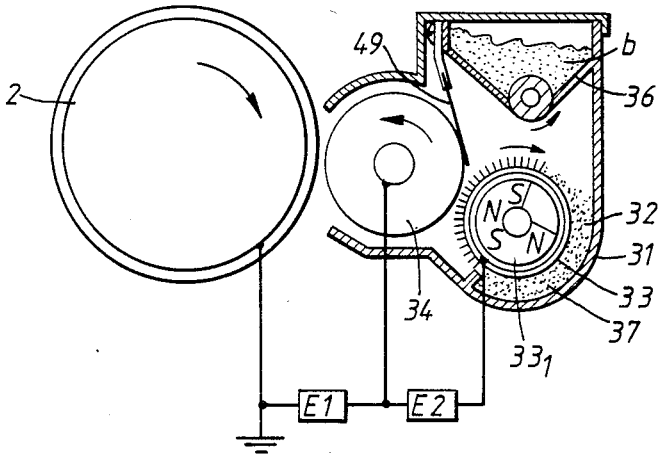
FIG. 5 is a modified structural diagram of the developing device according to the present invention.
Figure 6:
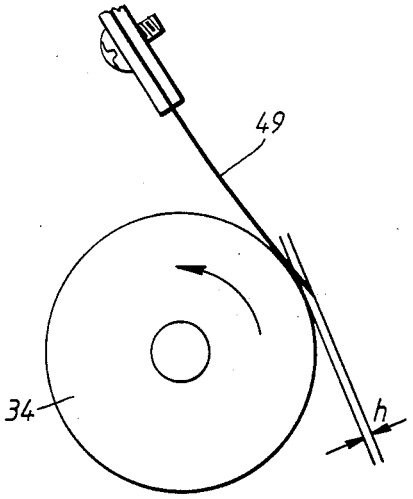
FIG. 6 is an explanatory view of the essential parts of FIG. 5.

It is to be understood that the foregoing description is a preferred embodiment of the disclosed device and that various changes in construction as shown in FIGS. 5 and 6 may be made in the invention. In these examples, an elastic blade 49 for preventing scattering of toner and for triboelectric charging of toner b is positioned so that the contacting end thereof faces the rotation of the developing roller 34 as shown in the drawings. Further, as shown in FIG. 6, the gap h formed between the projection at the end of the elastic blade 49 and the developing roller 34 is adjusted so that it is smaller than the particles of carrier a in the developer to be used. Therefore, when carriers erroneously adhere to developing roller 34 at separation of toner from a magnetic brush, no carrier intrudes into the gap, and damage of the developing roller 34 and striping of the toner layer T are prevented. In this case, it is preferable that the diameter of the carriers a is comparatively large, preferably 80–150 μm.

As described above, according to the present invention, scattering of toner of a non-contacting developing device of two component developer separation system can be completely prevented, and the toner layer can be uniformized by a very easy and low-priced measure. Also, the toner density in the two component developer can be increased to more than the conventional density without scattering of toner. As a result, separation of toner can be effectively performed, but charging of toner is insufficient in this state. However, triboelectric charging of toner is performed by sliding contact of the elastic blade 40 or the elastic blade 49, and a compensation sufficient for obtaining a good image quality is performed. Therefore, it can be said that the performance of a conventional developing device can be improved in every aspect.

What is claimed is:

1. A developing device comprising:

(a) a casing enclosed but for a single opening;

(b) a developing roller mounted in said casing and protruding through the single opening in said casing;

(c) a developer bearing roller mounted in said casing in operative association with said developing roller;

(d) first means for rotating said developing roller in a first direction;

(e) second means for rotating said developer bearing roller in a second direction, opposite to said first direction;

(f) third means for creating a difference in electrical potential between the surface of said developing roller and the surface of said developer bearing roller;

(g) a first elastic blade having a fixed end and a free end, said first elastic blade being mounted on said casing above said developing roller and, during use of the device, making resilient sliding contact with toner particles on the surface of said developing roller intermediate its fixed end and its free end and across at least substantially the entire width of the single opening in said casing, whereby said first elastic blade extends both forwardly of and rearwardly of the line of contact between said first elastic blade and the toner particles and thereby prevents scattering of the toner particles outside said casing;

(h) a second elastic blade having a fixed end and a free end, said second elastic blade being mounted on said casing beneath said developing roller and, during use of the device, making resilient sliding contact with toner particles on the surface of said developing roller intermediate its fixed end and its free end and across at least substantially the entire width of the single opening in said casing, whereby said second elastic blade extends both forwardly of and rearwardly of the line of contact between said second elastic blade and the toner particles and thereby prevents scattering of toner particles outside said casing; and (i) a thickness regulating plate projecting from said casing and extending toward but not contacting said developer bearing roller.

2. A developing device as recited in claim 1 and further comprising a toner hopper mounted in said casing above said developer bearing roller in position to drop toner particles onto said developer bearing roller.

3. A developing device as recited in claim 1 wherein said developer bearing roller comprises a non-magnetic sleeve and a magnet disposed inside said non-magnetic sleeve.

4. A developing device as recited in claim 1 wherein said developing roller comprises a conductive member and an insulative or resistive layer of 5–60 μm. thickness formed on the surface of said conductive member.

5. A developing device as recited in claim 1 wherein:

(a) said developing roller comprises a conductive roller;

(b) the electrostatic image is formed on a photosensitive drum; and (c) said conductive roller is rotated at substantially the same speed as the peripheral speed of the photosensitive drum.

6. A developing device as recited in claim 1 wherein said third means include a DC voltage source.

7. A developing device as recited in claim 1 wherein said developer bearing roller is a non-magnetic cylindrical sleeve roller.

8. A developing device as recited in claim 1 wherein said thickness regulating plate projects from said casing beneath said developing roller.

9. A developing device as recited in claim 1 wherein the free end of said first elastic blade is away from the line of contact between said first elastic blade and said developing roller in the direction of rotation of said developing roller.

10. A developing device as recited in claim 1 wherein the free end of said first elastic blade is away from the line of contact between said first elastic blade and said developing roller in the direction opposite to the direction of rotation of said developing roller.

* * * * *